US005230650A

United States Patent [19]

Brayton

[11] Patent Number: 5,230,650

[45] Date of Patent: Jul. 27, 1993

[54] PROJECTILE TOY APPARATUS

[76] Inventor: Donald R. Brayton, 10 Hovey St., Glens Falls, N.Y. 12801

[21] Appl. No.: 824,377

[22] Filed: Jan. 23, 1992

[51] Int. Cl.[5] ..... A63H 33/26; A63H 33/22; A63B 65/00; A63B 65/02

[52] U.S. Cl. ..... 446/485; 446/219; 273/415; 273/417; 273/428

[58] Field of Search ..... 446/219, 46, 47, 485, 446/486, 490; 273/415, 416, 417, 419, 398, 399, 400, 401, 402, 428

[56] References Cited

U.S. PATENT DOCUMENTS

| | | | |
|---|---|---|---|
| 3,393,911 | 7/1968 | Lawson | 273/420 X |
| 3,467,388 | 9/1969 | Weiler | 273/400 X |
| 4,111,422 | 9/1978 | Burcenski | 273/402 X |
| 4,168,066 | 9/1979 | Sole et al. | 273/402 |
| 4,301,616 | 11/1981 | Gudgel | 446/47 |
| 4,635,943 | 1/1987 | Lumpkin | 273/402 |
| 4,826,179 | 5/1989 | Callaghan | 273/58 R X |
| 4,840,383 | 6/1989 | Lombardo | 273/420 |
| 5,016,891 | 5/1991 | Nelson | 273/417 X |
| 5,056,795 | 10/1991 | Buhrow | 273/415 X |
| 5,108,340 | 4/1992 | Farrow | 446/219 X |

FOREIGN PATENT DOCUMENTS

| | | | |
|---|---|---|---|
| 2631552 | 11/1989 | France | 273/428 |
| 2241897 | 9/1991 | United Kingdom | 273/417 |

OTHER PUBLICATIONS

Lawn Jarts (Darts), The Sporting Goods Dealer, 1-72, p. 338.

*Primary Examiner*—D. Neal Muir
*Attorney, Agent, or Firm*—Leon Gilden

[57] ABSTRACT

A projectile toy includes a plurality of opposing target hoops arranged for selective securement to upper distal end portions of mounting posts. The projectiles are arranged of varying and contrasting colorations utilizing a semi-spherical head formed with a conical central tail portion and a rear tail web for manual grasping of the projectile to permit its hurtling towards an opposing target ring.

1 Claim, 4 Drawing Sheets

PROJECTILE TOY APPARATUS

BACKGROUND OF THE INVENTION

1. Field of the Invention

The field of invention relates to toy apparatus, and more particularly pertains to a new and improved projectile toy apparatus wherein the same is arranged to provide for target rings to receive conical projectiles therethrough.

2. Description of the Prior Art

Various toss games are utilized throughout the prior art, where frequently such toss games are dangerous such as those of elongate dart members and the like. The instant invention provides for a game apparatus devoid of rigid portions to avoid injury to an associated player employing the game apparatus. Examples of prior art structure are set forth in the U.S. Pat. No. 4,111,422 to Burcenski where a lawn game is utilized with a stick to launch a projectile to a target ring.

U.S. Pat. No. 4,887,822 to Tsai sets forth an outdoor dart game utilizing a sounding chamber at the forward end of the dart.

U.S. Pat. No. 4,453,713 to Guier sets forth a lawn game with vertically slidable targets.

As such, it may be appreciated that there continues to be a need for a new and improved projectile toy apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of toy apparatus now present in the prior art, the present invention provides a projectile toy apparatus wherein the same is arranged to provide for cushioned projectiles to be directed at opposing target rings. As such, the general purpose of the present invention, which will be described subsequently in greater detail, is to provide a new and improved projectile toy apparatus which has all the advantages of the prior art toy apparatus and none of the disadvantages.

To attain this, the present invention provides a projectile toy including a plurality of opposing target hoops arranged for selective securement to upper distal end portions of mounting posts. The projectiles are arranged of varying and contrasting colorations utilizing a semi-spherical head formed with a conical central tail portion and a rear tail web for manual grasping of the projectile to permit its hurtling towards an opposing target ring.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved projectile toy apparatus which has all the advantages of the prior art toy apparatus and none of the disadvantages.

It is another object of the present invention to provide a new and improved projectile toy apparatus which may be easily and efficiently manufactured and marketed.

It is a further object of the present invention to provide a new and improved projectile toy apparatus which is of a durable and reliable construction.

An even further object of the present invention is to provide a new and improved projectile toy apparatus which is susceptible of a low cost of manufacture with regard to both materials and labor, and which accordingly is then susceptible of low prices of sale to the consuming public, thereby making such projectile toy apparatus economically available to the buying public.

Still yet another object of the present invention is to provide a new and improved projectile toy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
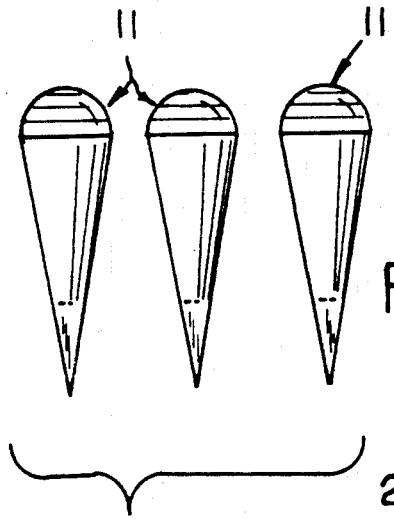
FIG. 1 and FIG. 2 are orthographic side views of opposing projectiles utilized by the invention.
Figure 2:
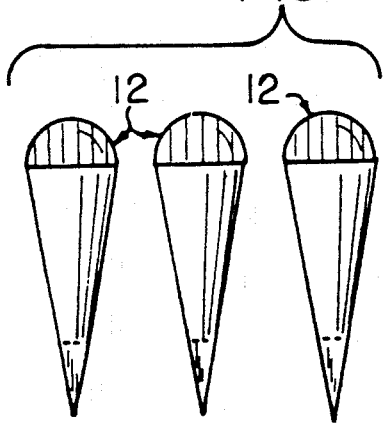
Figure 3:
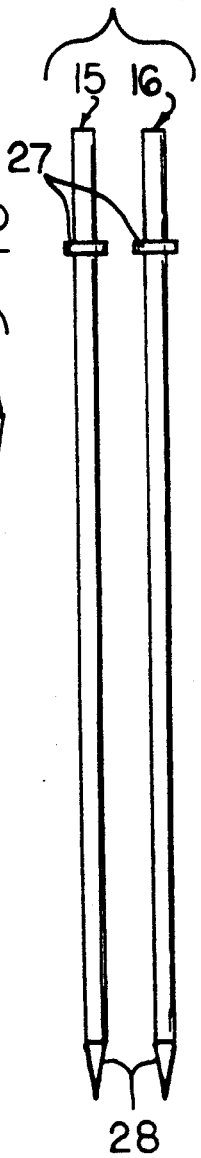
FIG. 3 is an orthographic view of support posts utilized by the invention.
Figure 4:
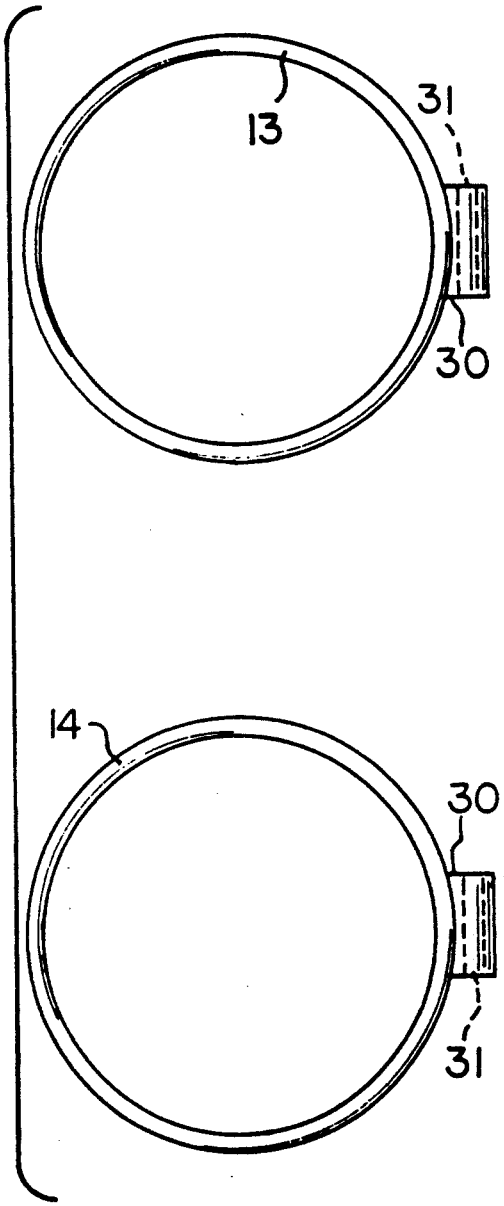
FIG. 4 is an orthographic top view of target rings utilized by the invention.
Figure 5:
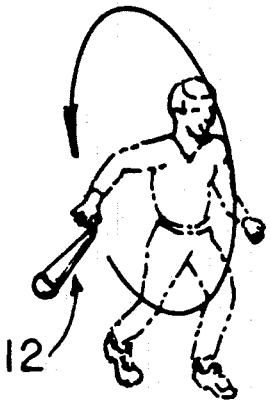
FIG. 5 is an isometric illustration of an individual swinging a projectile for projection towards a target ring.

With reference now to the drawings, and in particular to FIGS. 1 to 17 thereof, a new and improved projectile toy apparatus embodying the principles and concepts of the present invention and generally designated by the reference numerals 11-39 will be described.

More specifically, the projectile toy apparatus of the invention essentially comprises a plurality of sets of projectile cones including a first set of projectile cones 11 and a second set of projectile cones 12. Each of the individual projection cones include a semi-spherical head 17 (see FIGS. 8 and 9), with a conical tail portion extending rearwardly and coaxially aligned relative to the semi-cylindrical head. A grasping web 22 extends rearwardly in coaxial alignment with the conical tail portion 20 to permit manual grasping of the projectile. A first and second target ring 13 and 14 respectively are afforded opposing players that are selectively mounted upon a respective first and second mounting post 15 and 16.

Figure 8:
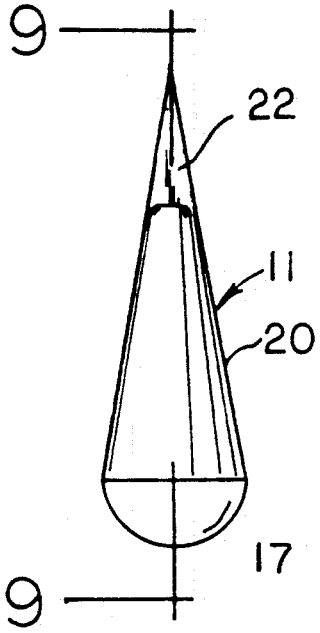
FIG. 8 is an orthographic side view of a projectile target.
Figure 9:
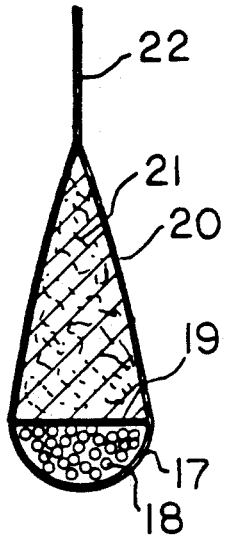
FIG. 9 is an orthographic view, taken along the lines 9—9 of FIG. 8 in the direction indicated by the arrows.
Figure 10:
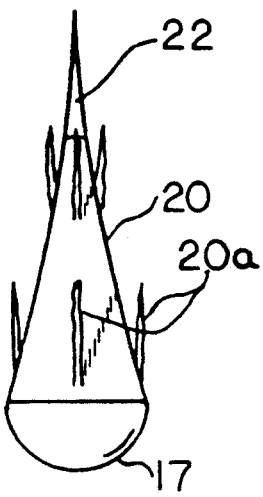
FIG. 10–15 are modified projectiles utilized by the invention.
Figure 11:
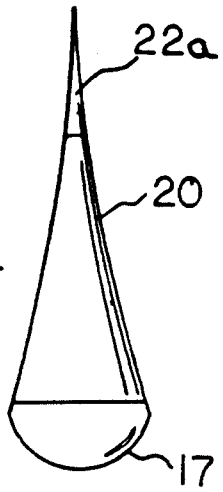
Figure 12:
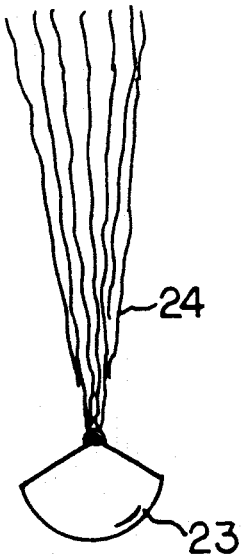
Figure 13:
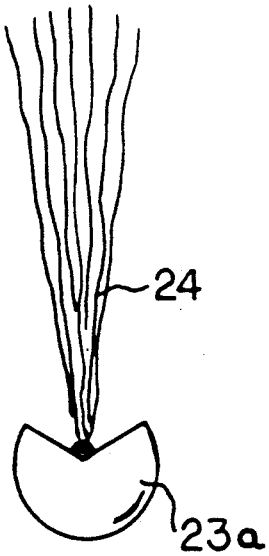
Figure 14:
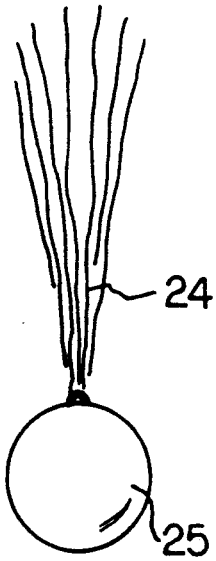
Figure 15:
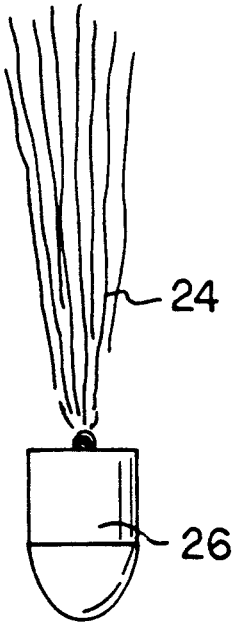

With reference to FIGS. 8 and 9, the semi-spherical head 17 includes a flexible covering to surroundingly enclose a quantity of pellet members 18, such as beans, plastic beads, and the like, within the semi-spherical head 17 bounded by a web floor 19. Extending coaxially relative to the web floor is a conical tail portion 20 filled with a fibrous wadding material 21 to insure cushioning upon impact, be it with the target 13 or 14 or another player. In this manner, inadvertent injury is avoided in use of the invention. The FIG. 10 illustrates the use of streamer flaps 20*a* of contrasting colorations mounted about the conical tail portion 20. The FIG. 11 includes a conical grasping web 22*a*, wherein the FIGS. 12 and 13 are provided with a respective first and second spherical head segment to include elongate streamer filaments 24 extending rearwardly thereof. Alternatively, a spherical shape 25, such as illustrated in FIG. 14, or a bullet shape 26, may be utilized. It should be noted, however, that the preferred embodiment of the invention employs the projectile structure as illustrated in the FIGS. 1, 2, 8, and 9.

Figure 7:
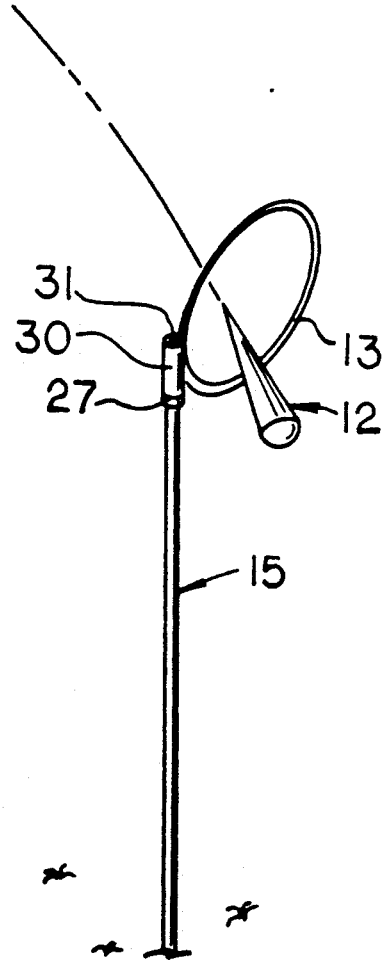
FIG.7 is an isometric illustration of a target ring mounted in a vertical orientation upon an associated support post.
Figure 6:
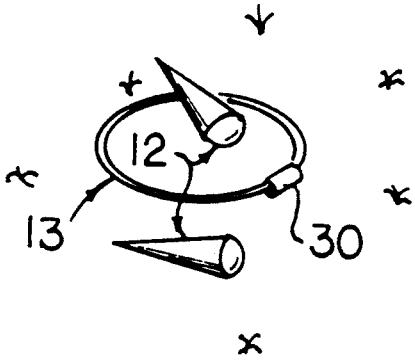
FIG. 6 is an isometric illustration of a target ring in a horizontal orientation upon a supporting ground surface.

The mounting posts 15 and 16 each include a collar abutment 27 coaxially aligned with and spaced below an upper distal end of the respective mounting posts, with each mounting post including a pointed lower end 28 for projection within an underlying ground surface, as illustrated in FIG. 7.

The target rings 13 and 14 each include a tubular sleeve 30 that includes a post receiving bore 31 therethrough, wherein each bore 31 is tangentially oriented relative to each respective target ring. In this manner, the ring may be mounted in a vertical orientation, such as illustrated in FIG. 7. Alternatively, the ring may be positioned upon a ground surface for horizontal orientation.

Figure 16:
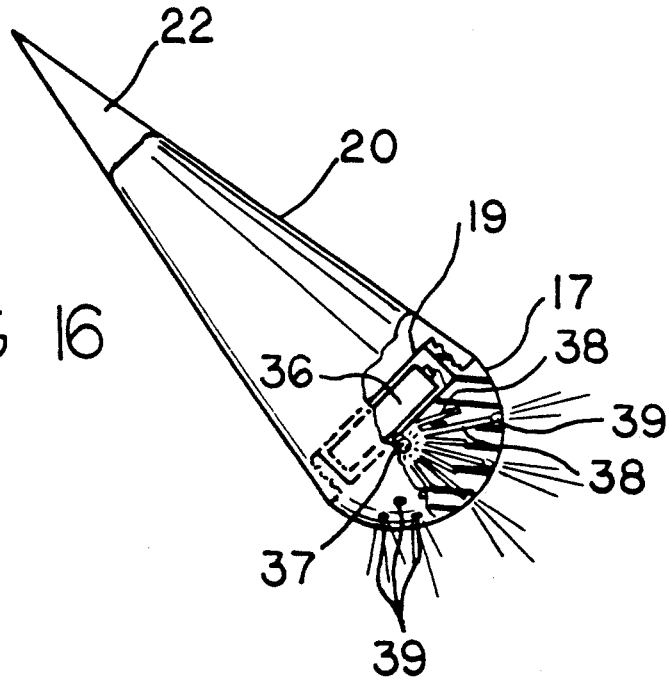
FIG. 16 is an orthographic side view of a modified projectile utilized by the invention.
Figure 17:
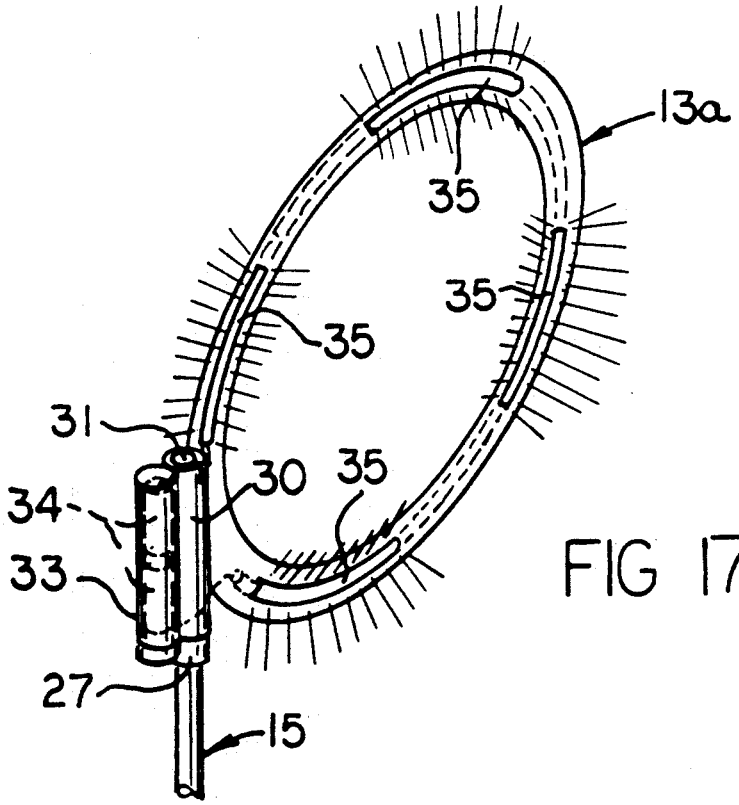
FIG. 17 is an isometric illustration of a modified target ring utilized by the invention.

The FIG. 16 illustrates the use of a further modified projectile to incorporate it with a modified target ring 13*a*. The target ring includes a battery housing 33 fixedly mounted to the tubular sleeve 30 diametrically opposed to the mounting of the associated ring structure, with the battery housing including at least one, if not a plurality, of batteries 34 to effect an electrical communication with arcuate illumination bulbs mounted within the housing of the ring 13*a* to provide illumination during periods of limited available light, such as in evening hours. The illumination bulbs 35 are denoted as first illumination bulbs and remain illuminated to ease viewing of the target. It should be noted that the illumination bulbs are arranged to substantially effect in a surrounding relationship relative to the central opening of the target ring.

The modified projectile, as illustrated in FIG. 16, includes a second battery 36 contained within the projectile adjacent the head web floor 19. Illumination bulb 37 is accordingly in electrical communication with the second battery 36 and positioned in contiguous or adjacency relative to rear distal ends of a plurality of fiber optic cables 38. The fiber optic cables 38 are radially oriented relative to the second illumination bulb 37 which is concentrically mounted within the semi-spherical head 17. Each fiber optic cable 38 is mounted within a cable bore 39 that is also radially aligned, wherein upon throwing of the projectiles, as illustrated in FIG. 16, the trajectory may be followed by the available lighting from the fiber optic cables 38 directed towards the illuminated modified ring structure 13*a*.

Scoring in play of the game may be formed along arbitrated lines, such as providing each player with two points through a successful directioning of a projectile through an associated hoop. It should be further noted that should all throws be successful in directing a projectile through an associated hoop, that player should be awarded a bonus plurality of points for such effort. It is contemplated further that the hoops be of substantially two feet in diameter for convenience of the players, but it is understood that any dimension to accommodate a player's abilities and needs may be provided and accordingly various hoops of varying diameters may be provided in association with various levels of skill attained by a player.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A projectile toy apparatus, comprising, a plurality of sets of projectiles, and the plurality of sets of projectiles including a plurality of first projectile cones, and a plurality of second projectile cones, and a first target ring associated with the first projectile cones, and a second target ring associated with the second projectile cones, and a first mounting post arranged for mounting the first target ring thereon, and a second mounting post arranged for mounting the second target ring thereon, and the first projectile cones and the second projectile cones are of a contrasting coloration, and each projectile cone of said projectile cones includes a semi-spherical head, the semi-spherical head mounted to a planar head web floor, and a conical tail portion mounted to the head web floor extending rearwardly of the semi-spherical head coaxially aligned, and a grasping web extending rearwardly of the conical tail portion mounted thereto, wherein the grasping web is of a flexible construction permitting ease of grasping of the grasping web, and the conical tail portion includes a fibrous wadding material mounted therewithin coextensively of the conical tail portion, and a projectile battery mounted within the conical tail portion adjacent the web floor, the battery in electrical communication with an illumination bulb, the illumination bulb concentrically mounted relative to the semi-spherical head, and a matrix of fiber optic cables radially directed through the semi-spherical head, with each fiber optic cable including a first terminal end position adjacent the illumination bulb, and each fiber optic cable mounted within a cable bore, and each fiber optic cable recessed relative to an exterior surface of the semi-spherical head, and each target ring includes a tubular sleeve, the tubular sleeve including a post recieving bore directed therethrough, wherein the post receiving bores tangentially oriented relative to the tubular sleeve, and each mounting post includes a torroidal collar concentrically mounted about the mounting post spaced from and adjacent an upper distal end of the mounting post, and the lower distal end of the mounting post including a pointed end for projection within an underlying surface, with the post receiving bore receiving the mounting post above the ring, and the target ring includes a plurality of arcuate illumination bulbs mounted within the ring arranged coextensively of the ring, and a battery housing mounted to the tubular sleeve diametrically opposed to the torroidal ring, and the battery housing including at least one ring battery mounted therewithin, and the ring battery in electrical communication with the arcuate illumination bulbs of the target ring.

* * * * *